US006391427B1

(12) United States Patent
Shaw-Klein et al.

(10) Patent No.: US 6,391,427 B1
(45) Date of Patent: May 21, 2002

(54) INK JET RECORDING ELEMENT

(75) Inventors: Lori J. Shaw-Klein, Rochester; Elizabeth A. Gallo, Penfield; Eric L. Dillenbeck, Rochester; Scott E. Derry, Brockport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/453,159

(22) Filed: Dec. 2, 1999

(51) Int. Cl.[7] ..... B41M 5/00; B41J 2/01

(52) U.S. Cl. ..... 428/195; 347/105; 347/106; 428/323; 428/328; 428/329; 428/330; 428/331

(58) Field of Search ..... 428/195, 328, 428/323, 329–331; 347/105, 106

(56) References Cited

U.S. PATENT DOCUMENTS 6,093,483 A * 7/2000 Tanuma ..... 428/195
6,110,601 A * 8/2000 Shaw-Klein et al. ..... 428/195
6,187,430 B1 * 2/2001 Mukoyoshi et al. ..... 428/331

FOREIGN PATENT DOCUMENTS

EP 813978 A1 12/1997

* cited by examiner

*Primary Examiner*—Pamela R. Schwartz
(74) *Attorney, Agent, or Firm*—Harold E. Cole

(57) ABSTRACT

An ink jet recording element, prior to image recording, comprising a substantially transparent support having thereon an image-recording layer comprising a polymeric binder, a colorant, and porous, colorless aggregates of particles having a primary particle size of from about 7 to about 40 nm in diameter and being aggregated up to about 300 nm.

14 Claims, No Drawings

INK JET RECORDING ELEMENT

FIELD OF THE INVENTION

The present invention relates to a substantially transparent, porous ink jet image-recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-recording layer, and includes those intended for reflection viewing, which have an opaque support, and those intended for viewing by transmitted light, which have a transparent support. Medical images, such as radiographic images, are typically viewed on a blue transparent support.

An important characteristic of ink jet receivers is their need to dry quickly after printing. To this end, porous receivers have been developed which provide nearly instantaneous drying as long as they have sufficient thickness and pore volume to effectively contain the liquid ink. For example, a porous receiver can be manufactured by cast coating, in which a particulate-containing coating is applied to a support and is dried in contact with a polished smooth surface.

When a porous receiver of the type described is coated and dried on a transparent support, optical scatter within the coating produces a white appearance. In medical imaging applications, blue transparencies are desired for radiographic imaging. However, when a porous fumed oxide coating is deposited on a transparent, blue-tinted support, it appears white when viewed in reflection, which is undesirable.

EP 813,978 relates to an ink jet recording element comprising an ink absorption layer containing solid fine particles, a binder and oil drops. However, there is a problem using this ink absorption layer on a transparent support in that an objectionable white appearance results due to scattering of visible light, as described above.

It is an object of this invention to provide a substantially transparent ink jet receiver in which the white appearance due to scattering of visible light is reduced. It is another object of this invention to provide a substantially transparent ink jet receiver which has a fast dry time.

SUMMARY OF THE INVENTION

These and other objects are achieved in accordance with the invention which comprises an ink jet recording element, prior to image recording, comprising a substantially transparent support having thereon an image-recording layer comprising a polymeric binder, a colorant, and porous, colorless aggregates of particles having a primary particle size of from about 7 to about 40 nm in diameter and being aggregated up to about 300 nm.

Another embodiment of the invention relates to an ink jet printing process comprising:

a) providing an ink jet recording element as described above, and b) applying liquid ink droplets thereon in an image-wise manner.

By use of the invention, a fast-drying image can be produced which has a reduced white appearance due to scattering of visible light.

DETAILED DESCRIPTION OF THE INVENTION

Particles useful in the invention include alumina, boehmite, clay, calcium carbonate, titanium dioxide, calcined clay, aluminosilicates, silica, barium sulfate, or polymeric beads. In a preferred embodiment of the invention, the particles are metallic oxides, such as alumina. While many types of inorganic and organic particles are manufactured by various methods and commercially available for an ink receiving layer, porosity is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small that they do not scatter visible light.

The most preferred particle type providing the above requirements are aggregates of small particles. The aggregates are typically 150–300 nm in dimension and are comprised of smaller primary particles about 7–40 nm in diameter. The pores in a dried coating of such aggregates fall within the range necessary to ensure low optical scatter yet sufficient ink vehicle uptake.

Silica and alumina fumed oxides are well known, and alumina fumed oxides are preferred. Fumed oxides are available in dry form or as dispersions of the aggregates mentioned above.

In a preferred embodiment of the invention, the polymeric binder is a hydrophilic polymer. Examples of such hydrophilic materials include, but are not limited to, polyvinyl alcohols and their derivatives, polyvinyl pyrrolidone, sulfonated or phosphated polyesters, cellulose ethers and their derivatives, poly(2-ethyl-2-oxazoline), gelatin, casein, zein, albumin, chitin, chitosan, dextran, pectin, collagen derivatives, collodian, agar-agar, arrowroot, guar, carrageenan, tragacanth, xanthan, rhamsan, sulfonated polystyrenes, acrylamides and their derivatives, poly (alkylene oxides) and the like. In a preferred embodiment of the invention the hydrophilic polymer is poly(vinyl alcohol), hydroxypropyl cellulose, hydroxypropyl methyl cellulose or a poly(alkylene oxide).

The binder material should be chosen so that it is compatible with the aforementioned particles.

The amount of binder used should be sufficient to impart cohesive strength to the ink jet receiver, but should also be minimized so that the interconnected pore structure formed by the aggregates is not filled in by the binder. In a preferred embodiment of the invention, the volume ratio of binder to particles is from about 1:4 to about 1:2.

Since the image-recording layer is a porous layer comprising particles, the void volume must be sufficient to absorb all of the printing ink. For example, if a porous layer has 60 volume % open pores, in order to instantly absorb 32 $cc/m^2$ of ink, it must have a physical thickness of at least about 54 $\mu m$.

Suitable support materials useful in the invention include polymeric film materials such as tinted or untinted poly (ethylene terephthalate), polyethylene naphthalate, poly-1, 4-cyclohexane dimethylene terephthalate, polyvinyl chloride, polyimide, polycarbonate, polystyrene, cellulose acetate, or cellulose acetate propionate. In a preferred embodiment of the invention, the support is poly(ethylene terephthalate). Such film materials may be pretreated with an adhesion promoting layer, an antistatic layer, or a curl control layer as known in the art.

The support generally has a thickness of from about 50 to about 500 $\mu$m, preferably from about 75 to 300 $\mu$m. Antioxidants, antistatic agents, plasticizers, and other known additives may be incorporated into the support, if desired.

In order to improve the adhesion of the image-recording layer to the support, the surface of the support may be subjected to a corona-discharge treatment prior to applying the image-recording layer.

Furthermore, if the colorant in the image-recording layer is a dye chosen to match the color of the tinted transparency, a clear support may be used with the image-recording layer providing both the desired background color and ink receptive properties.

Colorants useful in the invention can be classified as either dyes or pigments. If a dye is used, the dye molecules are dispersed or solvated by the liquid or solid medium, so that each individual dye molecule is surrounded by molecules of the liquid or solid medium. Dyes are soluble in aqueous and organic solvents, thus particles are not observable under a microscope. If a pigment is used, discrete particles are dispersed in a liquid or solid medium. Each particle consists of many dye molecules held together by strong intermolecular forces. Pigment-based colorants are not soluble in aqueous and organic solvents, and particles ranging from 0.01 to 1.0 micron are observable under a microscope.

In a preferred embodiment of the invention, cationic or anionic dyes may be used. Cationic dyes are those dyes which yield colored cations in aqueous solution, and anionic dyes are those dyes which yield colored anions in aqueous solution. Cationic dyes usually contain quaternary nitrogen groups as the ionic moiety and encompass all basic dyes. Anionic dyes usually contain sulfonic or carboxylic acid groups as the ionic moiety and encompass all acid groups.

Types of cationic dyes that may be used include the C.I. Basic dyes, e.g., Basic Yellows 9, 11,13 and 51 for yellow dyes; Basic Reds 1 and 3 and Basic Violets 7, 10 and 23 for magenta dyes; Basic Blues 3, 9 and 75 for cyan dyes; and Basic Blacks 2 and 8 for black dyes; and the C.I. Mordant dyes, e.g. Mordant Green 13, that are designed to bind acidic sites on substrates such as fibers.

Useful cationic dyes include azine compounds, oxazine compounds, thiazine compounds, azo compounds, diphenylmethane compounds, triarylmethane compounds, xanthene compounds, acridine compounds, quinoline compounds, methine or polymethine compounds, thiazole compounds, indamine or indophenol compounds, among others, all of which are well known to those skilled in the art.

Anionic dyes that may be used in the invention include the C.I. Acid, Direct, Food, Mordant and Reactive dyes such as Acid Blue 9, Direct Blue 199, Acid Red 52, Reactive Red 23, Acid Yellow 23, Direct Yellow 132, Food Black 2 and Reactive Black 31. Useful anionic dyes include nitroso compounds, nitro compounds, azo compounds, stilbene compounds, triarylmethane compounds, xanthene compounds, quinoline compounds, thiazole compounds, azine compounds, oxazine compounds, thiazine compounds, aminoketone compounds; anthraquinone compounds, indigoid compounds and phthalocyanine compounds, among others, all of which are well known to those skilled in the art.

Especially preferred are the lactate salts of Dye 1 (protonated C.I. Basic Blue 75) and Dye 2 illustrated below:

Dye 1 (Basic Blue 75)

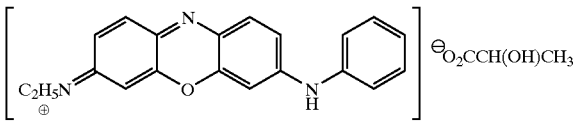

$\lambda_{max}$ = 642 nm ($H_2O$)

Dye 2

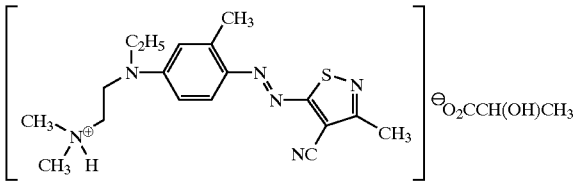

$\lambda_{max}$ = 550 nm ($H_2O$)

The colorant may be present in any amount effective for the intended purpose. In general, good results have been obtained when the colorant is present in an amount of from about 0.01 g/m$^2$ to about 0.05 g/m$^2$.

If the particles forming the porous image-recording layer are primarily anionic, such as fumed silica, anionic dyes preferred. If particles having a high point of zero charge, such as fumed alumina are employed, cationic dyes are preferably used in order to provide melt stability.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published Dec. 1989, pages 1007 to 1008. Slide coating is preferred, in which the base layers and overcoat may be simultaneously applied. After coating, the layers are generally dried by simple evaporation, which may be accelerated by known techniques such as convection heating.

The image-recording layer may contain dye mordants as additives to improve water resistance. For example, if the printing dyes are primarily anionic, quaternary ammonium or phosphonium containing polymers, surfactants, etc may be added. Alternately, other mordanting materials well known in the art may be selected, such as amine containing polymers or simply a polymer or species carrying positive charges.

In order to impart mechanical durability to an inkjet receiver, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV stabilizers and absorbers may also be added to the image-recording layer as is well known in the art.

In order to obtain adequate coatability, additives known to those familiar with such art such as surfactants, defoamers, alcohol and the like may be used. A common level for coating aids is 0.01 to 0.30 per cent active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Element 1

This element was made by coating a support with a liquid of fumed alumina, CEP10AK97003, (Cabot Corporation) and polyvinyl alcohol, Elvanol® 52/22, (DuPont Corp) such that the weight ratio of alumina to PVA was 90 to 10 and the total solid content in water was 30% by weight. The liquid was coated using a wound wire rod at a wet thickness of 100 μm and dried at 100° C. The support was a clear transparent poly(ethylene terephthalate) having an adhesion promoting layer comprised of a terpolymer of acrylonitrile, vinylidene chloride and acrylic acid.

Element 2

This element was prepared the same as Element 1 except that the support was a blue transparent poly(ethylene terephthalate) support which had an adhesion promoting "sub" comprised primarily of gelatin.

Control 1

This element used the support of Element 2 without any coating.

Whiteness Testing

Whiteness was measured against a standard black background using a Minolta colorimeter. L*, a* and b* were measured directly to describe the color. L* provides a good measure of whiteness (lightness), with higher values of L* corresponding to a whiter measured surface. L*a*b* was also recorded for an uncoated area of the blue transparency. The following results were obtained:

TABLE 1

| Element | Coating | L* | a* | b* |
|---|---|---|---|---|
| 1 | Alumina/PVA | 58.6 | −1.5 | −25.9 |
| 2 | Alumina/PVA | 63.3 | −1.3 | −17.8 |
| Control 1 | none | 18.6 | −1.1 | −10.1 |

The above results show that when a blue support (Control 1) is coated with alumina, the L* values increase, thus indicating an objectionable white appearance due to scattering of visible light.

Example 2

Element 3

This element was the same as Element 1 except that it contained Dye 1 in an amount of 0.024 g/m$^2$ and Dye 2 above in an amount of 0.012 g/m$^2$.

Element 4

This element was the same as Element 2 except that it contained Dye 1 in an amount of 0.024 g/m$^2$ and Dye 2 above in an amount of 0.012 g/m$^2$.

In order to protonate the dyes, each neutral dye was added at a level of 0.7% by weight to a water/lactic acid solution (95/5 ratio by weight). Then, 2% of the cationic cyan dye solution and 1% of the cationic magenta dye solution by weight were added to the melt and it was coated as described above.

The elements were tested the same as in Example 1. The following results were obtained:

TABLE 2

| Element | L* | a* | b* |
|---|---|---|---|
| 3 | 48 | −0.1 | −35.1 |
| 4 | 49.3 | 0.9 | −37.3 |

A comparison of the L* values for elements 3 and 4 with 1 and 2 show a decrease of about 10 L* units. This indicates that the objectionable white appearance due to scattering of visible light has been reduced Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element, prior to image recording, comprising a substantially transparent support having thereon an image-recording layer comprising a polymeric binder, a colorant, and porous, colorless aggregates of particles having a primary particle size of from about 7 to about 40 nm in diameter and being aggregated up to about 300 nm; said colorant being a cationic dye or an anionic dye, which is present in an amount in order to reduce light scattering.

2. The recording element of claim 1 wherein said polymeric binder is a hydrophilic polymer.-

3. The recording element of claim 2 wherein said hydrophilic polymer is poly(vinyl alcohol), hydroxypropyl cellulose, hydroxypropyl methyl cellulose, or a poly (alkylene oxide).

4. The recording element of claim 1 wherein said polymeric binder is poly(vinyl alcohol).

5. The recording element of claim 1 wherein said particles are metallic oxides.

6. The recording element of claim 1 wherein said particles are alumina.

7. The recording element of claim 1 wherein the volume ratio of said binder to particles is from about 1:4 to about 1:2.

8. The recording element of claim 1 wherein said support is poly(ethylene terephthalate).

9. The recording element of claim 1 wherein said cationic dye is the lactate salt of protonated C.I. Basic Blue 75.

10. The recording element of claim 9 which also contains the following dye:

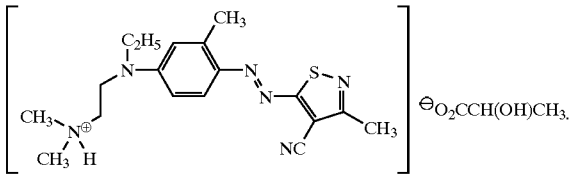

11. An ink jet printing process comprising:

a) providing an ink jet recording element according to claim 1, and b) applying liquid ink droplets thereon in an image-wise manner.

12. The process of claim 11 wherein said polymeric binder is a hydrophilic polymer.

13. The process of claim 11 wherein said particles are alumina.

14. The process of claim 11 wherein said dye is a cationic dye.

* * * * *